US012618319B1

(12) United States Patent
Johnson

(10) Patent No.: US 12,618,319 B1
(45) Date of Patent: May 5, 2026

(54) METHODS AND SYSTEMS FOR DETECTING AND MITIGATING DOWNHOLE MOTOR DYSFUNCTION

(71) Applicant: Schlumberger Technology Corporation, Sugar Land, TX (US)

(72) Inventor: Ashley Bernard Johnson, Cambridge (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 19/075,827

(22) Filed: Mar. 11, 2025

(51) Int. Cl.
*E21B 44/00* (2006.01)
*E21B 4/02* (2006.01)

(52) U.S. Cl.
CPC ..... *E21B 44/005* (2013.01); *E21B 4/02* (2013.01)

(58) Field of Classification Search
CPC ..... E21B 44/00; E21B 44/005; E21B 44/02; E21B 44/04; E21B 44/06; E21B 44/08; E21B 44/10; E21B 4/02
See application file for complete search history.

(56) References Cited

U.S. PATENT DOCUMENTS

2017/0152741 A1* 6/2017 Park ..... E21B 47/00
2021/0198997 A1* 7/2021 Moore ..... E21B 47/007
2021/0270097 A1* 9/2021 Ng ..... E21B 3/022
2024/0133287 A1 4/2024 Johnson

OTHER PUBLICATIONS

Alameer, M., et al., "Real-Time Mud Motor Stall Detection Using Downhole and Surface Data for Improved Performance Management and Failure Mitigation", SPE Annual Technical Conference and Exhibition, SPE-210105-MS, Oct. 3, 2022, pp. 1-15.
Zomarah, B., et al., "Early Warning Method to Detect Mud Motor Stallings Incidents in Drilling Operations Using Machine Learning", International Petroleum Technology Conference, IPTC-24183-MS, Feb. 12, 2024, pp. 1-11.

* cited by examiner

*Primary Examiner* — Yanick A Akaragwe
(74) *Attorney, Agent, or Firm* — Jeffrey D. Frantz

(57) ABSTRACT

Methods and systems are provided for detecting and mitigating stall of a downhole motor driven by flow of drilling fluid through the downhole motor, which employ a BHA that includes at least one first downhole sensor and at least one second downhole sensor operably disposed above the downhole motor. The methods and systems generate time-series first data representing measurements of the rotational speed of a collar disposed at the uphole end of the downhole motor or part of the BHA disposed above the downhole motor made by the at least one first downhole sensor over time as well as time-series second data representing measurements of the vibration of the BHA made by the at least one second downhole sensor over time. Stall of the downhole motor can be automatically detected by analysis of the time-series first data and the time-series second data. Upon detecting stall of the downhole motor, at least one action can be initiated to mitigate the stall of the downhole motor.

19 Claims, 9 Drawing Sheets

METHODS AND SYSTEMS FOR DETECTING AND MITIGATING DOWNHOLE MOTOR DYSFUNCTION

BACKGROUND

This section provides background information to facilitate a better understanding of the various aspects of the disclosure. It should be understood that the statements in this section of this document are to be read in this light, and not as admissions of prior art.

Oil and gas reservoirs may be accessed by drilling wellbores to enable the production of hydrocarbon fluid, e.g., oil and/or gas, to a surface location. Geothermal reservoirs may be accessed by drilling wellbores to enable the production of geothermal fluid, e.g., steam or hot working fluid, to a surface location. In many environments, directional drilling systems are used to gain better access to the desired reservoirs by forming deviated wellbores as opposed to traditional vertical wellbores.

A directional drilling system typically employ a rotary steerable system (RSS) that enables control over the drilling direction. The RSS can often be classified as a push-the-bit system or a point-the-bit system. The RSS allow an operator to change the orientation of the drill bit while drilling and thus the direction of the wellbore while drilling.

Directional drilling systems also typically employ a mud motor that drives rotation of the RSS and the drill bit. The mud motor is a progressive cavity positive displacement (PCPD) pump that uses drilling fluid to create rotary motion of a rotor in the motor's power section. The rotary motion of the rotor is transmitted to the RSS and the drill bit. Mud motors are prone to operational and environmental damage, with fatigue in the power section ultimately leading to failure. Typically, an elastomer forms a rubber lining between the walls of the rotor and stator of the mud motor. As directional drilling systems are used to drill deeper and longer lateral wellbores in hotter environments, elastomer failure remains a significant bottleneck in drilling performance. Mud motor failure can contribute to excessive non-productive time associated with tripping the mud motor out and possibly replacing it altogether, causing operators to fall behind operational targets. In addition to failure, mud motor damage can also compromise drilling efficiency even in cases where the target depth of the wellbore is successfully reached. These deficiencies create significant cost increases for directional drilling operations and are a critical problem to be solved.

Motor stalls (also referred to as "full motor stalls" herein) are known to be a significant contributor to damage of the elastomer of a mud motor during drilling. A motor stall occurs when the mud motor generates insufficient torque to overcome the power demand created by excessive weight on bit or sudden changes in formation, causing the bit to stop rotating. The buildup and eventual release of excessive torsional and frictional forces can cause significant damage to the power section of the mud motor. With continued circulation, the drilling fluid can force its way between the rotor and elastomer, eventually leading to chunking and erosion. Motor stalls typically occur without warning and last for a small duration of time, usually tens of seconds or more. Generally this requires intervention from the rig.

Micro motor stall is a precursor to full motor stall and lasts only for a very short duration of time typically less than 10 seconds and the motor will restart without intervention. Micro motor stall can be a driver for accelerated wear and pressure pulsations which can damage other tools. As such, micro motor stall is an indicator of potential wear and tool damage. Effectively detecting and mitigating micro motor stall can bring benefits in performance and reliability of the directional drilling system.

SUMMARY

This summary is provided to introduce a selection of concepts that are further described below in the detailed description. This summary is not intended to identify key or essential features of the claimed subject matter, nor is it intended to be used as an aid in limiting the scope of claimed subject matter.

In some embodiments, the techniques described herein relate to a method for detecting and mitigating stall of a downhole motor. A bottomhole assembly (BHA) can be provided that includes a downhole motor driven by flow of drilling fluid through the downhole motor, and at least one first downhole sensor and at least one second downhole sensor which are both operably disposed above the downhole motor. The at least one first downhole sensor can be configured to measure rotational speed of a collar that is disposed on the uphole end of the downhole motor or that is part of the BHA disposed above the downhole motor. The at least one second downhole sensor can be configured to measure vibration of the BHA. Time-series first data representing measurements of the rotational speed of the collar made by the at least one first downhole sensor over time can be generated and stored. Time-series second data representing measurements of the vibration of the BHA made by the at least one second downhole sensor over time can be generated and stored. Stall of the downhole motor can be automatically determined by analysis of the time-series first data and the time-series second data. Upon detecting stall of the downhole motor, at least one action to mitigate the stall of the downhole motor can be initiated.

In other embodiments, a directional drilling system is provided that includes a bottomhole assembly (BHA) having a drill bit, a downhole motor, and at least one first downhole sensor and at least one second downhole sensor which are both operably disposed above the downhole motor. The downhole motor is driven by flow of drilling fluid through the downhole motor. The at least one first downhole sensor can be configured to measure rotational speed of a collar that is disposed on the uphole end of the downhole motor or that is part of the BHA disposed above the downhole motor. The at the least one second downhole sensor can be configured to measure vibration of the BHA. At least one processor can be configured to:

i) generate time-series first data representing measurements of the rotational speed of the collar made by the at least one first downhole sensor over time;
ii) generate time-series second data representing measurements of the vibration of the BHA made by the at least one second downhole sensor over time;
iii) automatically detect stall of the downhole motor by analysis of the time-series first data and the time-series second data; and
iv) upon detecting stall of the downhole motor, initiate at least one action to mitigate the stall of the downhole motor.

In embodiments, the analysis of the time-series first data and the time-series second data can be configured to automatically detect stall of the downhole motor if and when the time-series first data corresponds to, or indicates, a stationary collar at or near null rotational speed and the time-series second data corresponds to, or indicates, a drop in vibration synchronous to the stationary collar at or near null rotational speed.

In other embodiments, the analysis of the time-series first data and the time-series second data can be configured to automatically detect stall of the downhole motor if and when the time-series first data corresponds to, or indicates, a drop in rotational speed of the collar and the time-series second data corresponds to, or indicates, a drop in vibration synchronous to the drop in rotational speed of the collar.

In embodiments, the at least one action can involve alerting a drilling operator to the stall of the downhole motor, such as by communication or display of a message or indicator of the stall of the downhole motor.

In embodiments, the at least one action can further involve the drilling operator adjusting flow rate of the drilling fluid flowing through the downhole motor or adjusting motor speed of the downhole motor.

In embodiments, the at least one action can involve issuing and communicating at least one control command that automatically adjusts flow rate of the drilling fluid flowing through the downhole motor or automatically adjusts motor speed of the downhole motor.

In embodiments, the at least one control command can be issued by a control system or processor.

In embodiments, the stall of the downhole motor can be a micro motor stall event or a full motor stall event.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
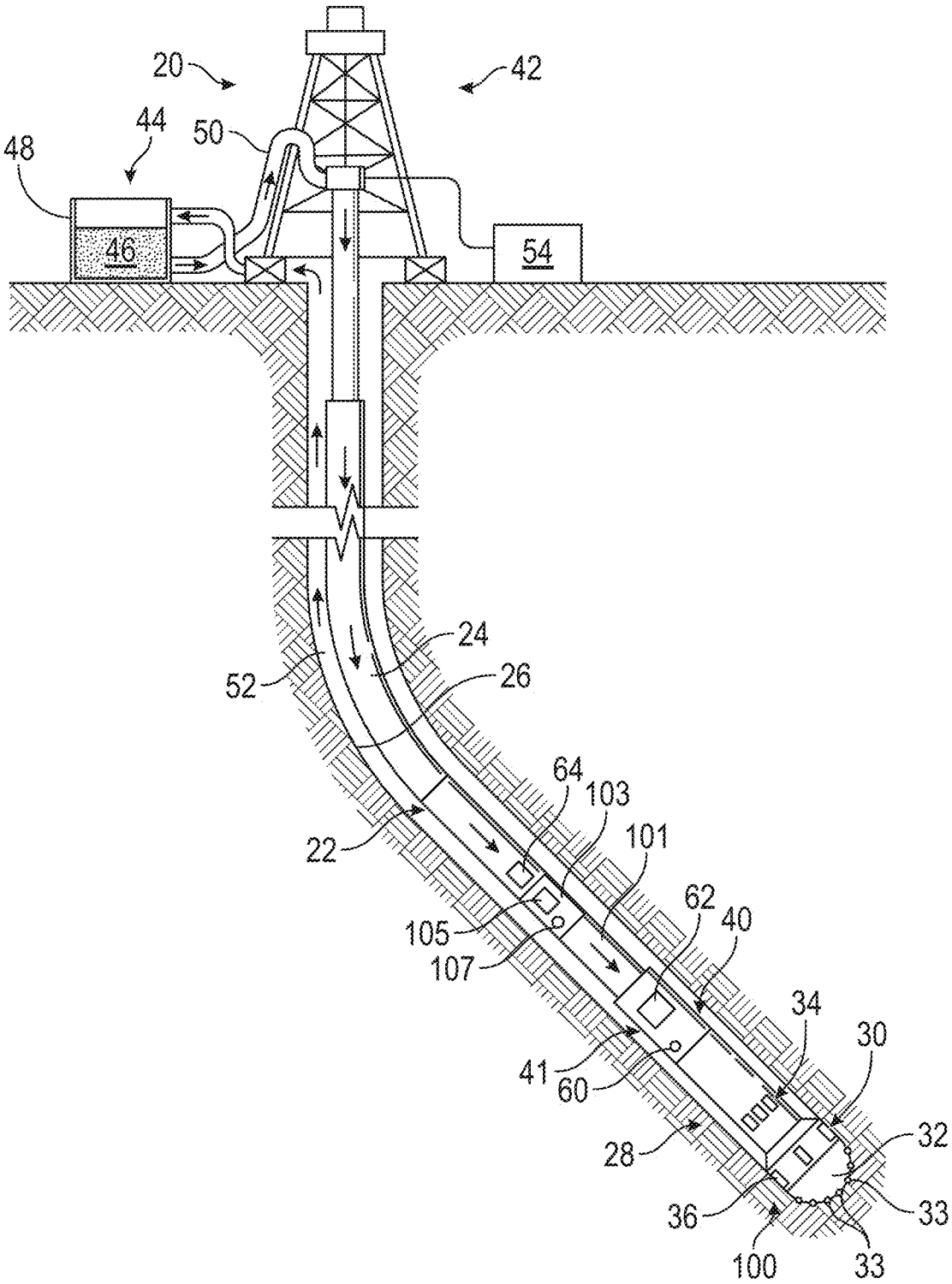
FIG. 1 is a schematic illustration of a directional drilling system that can embody one or more aspects of the present disclosure.

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details in more detail than is necessary for the fundamental understanding of the subject disclosure, the description taken with the drawings making apparent to those skilled in the art how the several forms of the subject disclosure may be embodied in practice. Furthermore, like reference numbers and designations in the various drawings indicate like elements.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and will not in itself dictate a relationship between the various embodiments and/or configurations discussed.

As used herein, the terms connect, connection, connected, in connection with, and connecting may be used to mean in direct connection with or in connection with via one or more elements. Similarly, the terms couple, coupling, coupled, coupled together, and coupled with may be used to mean directly coupled together or coupled together via one or more elements. Terms such as up, uphole, down, downhole, top and bottom and other like terms indicate relative positions to a given point or element and may be utilized to describe some elements. Commonly, these terms relate to a reference point such as the surface from which well drilling or servicing operations are initiated.

Micro motor stall of a mud motor in a directional drilling system differs from full motor stall as the micro motor stall is transient. Typically, pressure increase with a bit torque increase will increase the weight-on-bit, hence the torque and stall the mud motor of the directional drilling system. The pressure wave propagates up the wellbore and is reflected, which restarts the mud motor. A pressure spike at the surface can be associated with the micro motor stall, but such pressure spike is often missed, making it almost impossible to detect micro motor stalls from above the mud motor.

Because communication across a downhole motor has limited bandwidth and there is typically less shock and vibration above the downhole motor while drilling, there is a need to detect micro motor stalls from above the mud motor and effectively mitigate such micro motor stall upon detection.

Referring generally to FIG. 1, a directional drilling system 20 includes a bottom hole assembly (BHA) 22 supported by a drill string 24 which cooperate to drill wellbore 26. In embodiments, the drill string 24 can include drill pipe, coiled tubing, or other forms of conveying the BHA 22 in the wellbore 26 while drilling The BHA 22 includes a push-the-bit rotary steerable system (RSS) 28, which generally includes a bias unit 30 and drill bit 32 that together form a steering head 100. Bias unit 30 includes control valves 34 for directing drilling fluid to respective steering actuators 36, e.g., pistons and pads. The steering actuators 36 are moved from retracted positions toward extended positions in response to receiving the drilling fluid. Return movement of the steering actuators 36 to the retracted positions can occur as the drilling fluid supply to the steering actuator is stopped and the drilling fluid escapes to the annulus, for example via small diameter leakage pathways. Control valves 34 control the supply of drilling fluid to the steering actuators 36 under control of a control unit 62 (e.g., processor, memory, etc.) operationally connected to the bias unit 30. In embodiments, the control unit 62 can use information derived from one or more downhole sensors 60 (for example, inclination and azimuth sensors, e.g., accelerometers, inclinometers, magnetometers and rate gyros) and possibly commands downlinked from a surface controller to control the operation of the bias unit 30 (i.e., the operation of the control valves 34 and the steering actuators 36).

An electrical source 64 supplies electrical power to the control unit 62 and possibly the bias unit 30. In embodiments, the electrical source 64 can include one or more batteries and/or a turbine driven by drilling fluid. The control unit 62 may be configured to communicate with and/or interface to the downhole sensors 60 to sense various parameters including without limitation the toolface direction and thus the direction the wellbore 26 is being propagated. The control unit 62 may be constructed as a closed loop control system that controls the operation of the bias unit 30 (i.e., the operation of the control valves 34 and the steering actuators 36) based on the measurements received from the downhole sensors 60. The downhole sensors 60 may be disposed in various locations in the BHA 22 below the mud motor 101.

In embodiments, the drill string 24 may include several joints of drill pipe connected end-to-end through tool joints. In some embodiments, the drill string 24 may further include additional components such as subs, pup joints, etc. The drill pipe provides a hydraulic passage through which drilling fluid is pumped from the surface. The drilling fluid discharges through selected-size nozzles, jets, or other orifices in the bit 32 for the purposes of cooling the bit 32 and the cutting structures 33 thereon, and for lifting cuttings out of the wellbore 26 as the wellbore 26 is being drilled.

In accordance with embodiments, the BHA 22 includes a mud motor 101 that is coupled to the uphole end of the RSS 28 and is configured to drive rotation of the steering head 100 (which includes the bias unit 30 and the drill bit 32). The mud motor 101 is a progressive cavity positive displacement (PCPD) pump that uses drilling fluid to create rotary motion of a rotor in the power section of the mud motor. The rotary motion of the rotor is transmitted to the steering head 100.

In accordance with embodiments, the control unit 62 of the RSS 28 can interface to one or more downhole sensors 60 (such as gyroscopes, magnetometers, and accelerometers) to determine the trajectory (e.g., inclination and azimuth) of the wellbore in three-dimensional space while drilling. The control unit 62 can also interface to the downhole sensor(s) 60 to measure rotational speed of the steering head 100 and drill bit 32 while drilling. These measurements are made downhole, stored in solid-state memory and possibly transmitted to the surface. In other embodiments, the RSS 28 can be a point-the-bit type RSS with a suitable control unit and downhole sensor(s) configured to determine the trajectory (e.g., inclination and azimuth) of the wellbore in three-dimensional space while drilling and measure rotational speed of the drill bit 32 while drilling.

In accordance with embodiments, the BHA 22 further includes a module or sub 103 coupled to the uphole end of the mud motor 101 opposite the RSS 28 as shown in FIG. 1. The module of sub 103 houses a secondary control unit 105 and downhole sensors 107. The secondary control unit 105 may be configured to communicate with and/or interface to the downhole sensors 107 to measure dynamic properties of the BHA 22 while drilling. The downhole sensors 107 can include i) one or more gyroscopes or magnetometers for measuring rotational speed of a collar disposed on the uphole end of the mud motor 101 (or that is part of the BHA 22 disposed above the mud motor 101) while drilling and ii) accelerometers for measuring vibrations (e.g., axial and lateral vibrations) of the BHA 22 while drilling. The downhole sensors 107 can also include strain gauges for measuring torque, weight-on-bit and bending moment of the BHA 22, accelerometers for measuring continuous inclination of the BHA 22, and/or strain gauges or pressure sensors for measuring annular and internal pressure of the BHA 22. In embodiments, the downhole sensors 107 of the module 103 are disposed above the mud motor 101 and are configured to measure i) rotational speed of the collar over time while drilling and ii) vibrations (e.g., axial and lateral vibrations) of the BHA 22 over time while drilling. These measurements are made downhole, stored in solid-state memory and optionally transmitted to the surface. In embodiments, the module or sub 103 can be a MWD tool or a DMM tool (such as the OptiDrill tool of SLB of Houston, TX) coupled to the collar disposed on the uphole end of the mud motor 101.

The BHA 22 may include additional or other components coupled between the drill string 24 and the bit 32. Examples of additional BHA components include drill collars, stabilizers, measurement-while-drilling ("MWD") tools, logging-while-drilling ("LWD") tools, underreamers, section mills, hydraulic disconnects, jars, vibration or dampening tools, other components, or combinations of the foregoing.

The bit 32 of the BHA 22 may be any type of bit suitable for degrading downhole materials. For instance, the bit 32 may be a drill bit suitable for drilling the wellbore 26. Example types of drill bits used for drilling earth formations are fixed-cutter or drag bits. In other embodiments, the bit 32 may be a mill used for removing metal, composite, elastomer, other materials downhole, or combinations thereof. For instance, the bit 32 may be used with a whipstock to mill into casing lining the wellbore 26. The bit 32 may also be a junk mill used to mill away tools, plugs, cement, other materials within the wellbore 26, or combinations thereof. Swarf or other cuttings formed by use of a mill may be lifted to surface, or may be allowed to fall downhole Various surface systems can also form a part of the drilling system 20. In the example illustrated in FIG. 1, a drilling rig 42 is positioned above the wellbore 26 and a drilling fluid system 44 is used in cooperation with the drilling rig 42. For example, the drilling fluid system 44 may be configured to deliver drilling fluid 46 from a drilling fluid tank 48. The drilling fluid 46 is pumped through appropriate tubing 50 and delivered down through drilling rig 42 and into drill string 24. In many applications, the return flow of drilling fluid flows back up to the surface through an annulus between the drill string 24 and the surrounding wellbore wall (see arrows showing flow down through drill string 24 and up through annulus 52). The drilling system 20 also may comprise a surface control system 54 which may be used to communicate with the control unit 62 and the secondary control unit 105 via a suitable downhole telemetry system (not shown). The surface control system 54 may communicate with downhole telemetry system in various manners well known in the oil field arts, such as through mud pulse telemetry, electromagnetic telemetry, and hard-wired telemetry. Mud pulse telemetry uses pressure waves in the drilling fluid to transmit data between the surface control system 54 and the downhole telemetry system. Electromagnetic telemetry uses electromagnetic waves to transmit data between the surface control system 54 and the downhole telemetry system. Hard-wired telemetry uses wires/cables that are integral to the drill string 24 to transmit data between the surface control system 54 and the downhole telemetry system.

In embodiments, the directional drilling system can be used for on-shore drilling applications where the drilling rig 42 is located on dry land as shown in FIG. 1. In other embodiments, the directional drilling system can be used in offshore drilling applications where the drilling rig is located on an off-shore platform and drills into rock formations beneath a seabed or other body of water.

During operations, the mud motor 101 may experience a micro motor stall event where the collar (which is disposed on the uphole end of the mud motor 101 or part of the BHA 22 disposed above the mud motor 101) stops rotating (or experiences a large decrease in rotational speed). Such a micro motor stall event is a precursor to full motor stall and lasts for a very short duration of time, which is typically less than 10 seconds. The micro motor stall event can be a driver for accelerated wear and pressure pulsations which can damage other tools.

In accordance with at least one embodiment of the present disclosure, the downhole sensors 107 of the module 103 can be configured to measure i) rotational speed of the collar (which is disposed on the uphole end of the mud motor 101 or part of the BHA 22 disposed above the mud motor 101) over time while drilling and ii) vibrations (e.g., axial and lateral vibrations) of the BHA 22 over time while drilling. These measurements are made downhole, stored in solid-state memory and optionally transmitted to the surface. A processor can be configured to generate and store time-series first data representing the measurements of the rotational speed of the collar over time while drilling and time-series second data representing the measurements of vibration of the BHA 22 over time while drilling. The processor can be further configured to automatically detect one or more micro motor stall events of the mud motor 101 by analysis of the time-series first data and the time-series second data.

In embodiments, the processor that automatically detects the one or more micro motor stall events can be part of the surface control system 54 or part of one or more control units of the BHA.

In embodiments, when the processor detects a micro motor stall event while drilling, the processor can be configured to initiate action(s) to mitigate and/or eliminate the micro motor stall event in the mud motor.

Figure 2:
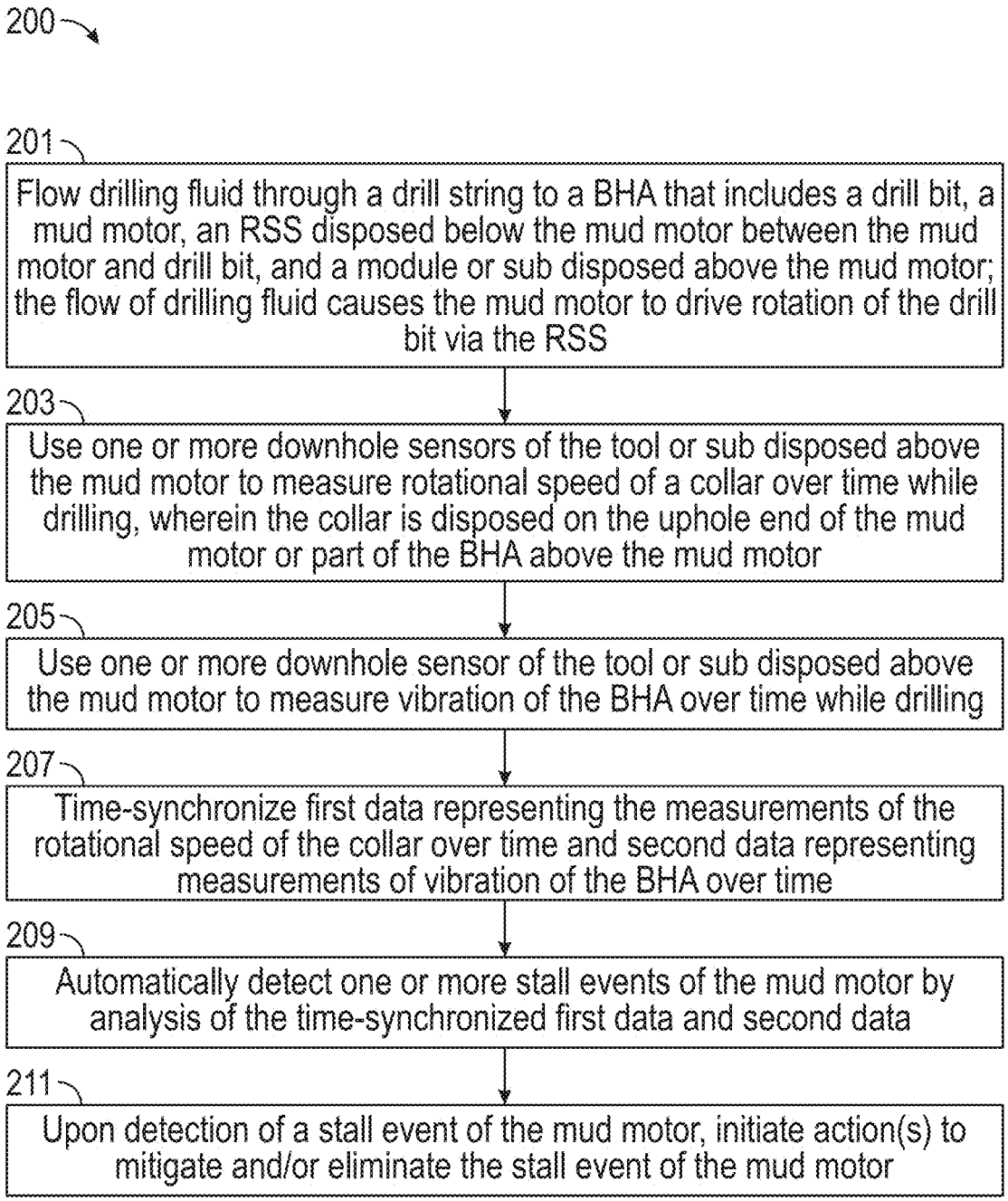
FIG. 2 is a flowchart of a method for detecting and mitigating micro motor stall events according to at least one embodiment of the present disclosure.

FIG. 2 and the corresponding text provides a series of acts for a method 200 for detecting and mitigating micro motor stall in accordance with at least one embodiment of the present disclosure. While FIG. 2 illustrates acts according to one embodiment, alternative embodiments may omit, add to, reorder, and/or modify any of the acts shown in FIG. 2. The acts of FIG. 2 can be performed as part of a method. Additionally or alternatively, a computer-readable medium can include instructions that, when executed by one or more processors, cause a computing device to perform some or all the acts of FIG. 2. In some embodiments, a drilling system can perform the acts of FIG. 2. In embodiments, some or all of the acts of FIG. 2 may be performed downhole. For example, some or all of the acts of FIG. 2 may be performed at a BHA or other downhole tool. In embodiments, some or all of the acts of FIG. 2 may be performed at a surface location.

The method 200 may include flowing drilling fluid through a drill string to a BHA at 201. The BHA can include a drill bit, a mud motor, an RSS disposed below the mud motor between the mud motor and drill bit, and a module or sub disposed above the mud motor as described above with respect to FIG. 1. The flow of drilling fluid causes the mud motor to drive rotation of the drill bit via the RSS. In other embodiments, other BHA configurations can be used.

One or more downhole sensors (such as one or more gyroscopes or magnetometers) of the tool or sub disposed above the mud motor can be used to measure rotational speed of a collar (which is disposed on the uphole end of the mud motor 101 or part of the BHA 22 disposed above the mud motor 101) over time while drilling at 203.

One or more downhole sensors (such as one or more accelerometers) of the tool or sub disposed above the mud motor can be used to measure vibration of the BHA over time while drilling at 205.

Times-series first data representing the measurements of the rotational speed of the collar over time of 203 can be generated and stored at 207.

Time-series second data representing the measurements of vibration of the BHA over time of 205 can be generated and stored at 209.

One or more stall events of the mud motor can be detected by analysis of the time-series first data and the time-series second data at 211.

In one embodiment, the analysis of 211 can process the time-series first data and the time-series second data to detect a stall event if and when the time-series first data corresponds to (or indicates) a stationary collar at or near null rotational speed and the time-series second data corresponds to (or indicates) a drop in vibration synchronous to the stationary collar at or near null rotational speed.

In embodiments, the stall of the downhole motor can be a micro motor stall event or a full motor stall event.

An example of the analysis of 211 that follows this embodiment is described below. First, the time-series first data can be processed to compute a characteristic rotational speed of the collar. For example, the characteristic rotational speed of the collar can be computed by applying a low pass filter with a bandwidth of around 0.5 Hz to the time-series first data. Second, the time-series second data can be processed to compute a characteristic vibration level of the BHA. For example, the characteristic vibration level of the BHA can be calculated as a root-mean-square of acceleration data over a time window of length 0.5 to 1, a peak amplitude of acceleration over time, or a spread between maximum and minimum acceleration over time. Such calculations can be performed for either or both axial acceleration over time and lateral acceleration over time. Third, the characteristic rotational speed of the collar over time can be evaluated using one or more conditions to detect if the collar of the mud motor is stationary at or near null rotational speed. For example, this condition can be detected when the characteristic rotational speed of the collar is below 5 to 10 rpm. Fourth, the characteristic vibration level of the BHA can be evaluated using one or more conditions to detect a synchronous drop in the time-series second data that corresponds to a micro motor stall event. For example, this condition can be detected when the root mean square of the axial acceleration over time is below 3 to 8 g or one or more of the lateral accelerations over time is below 12 to 20 g. In the case that the processing detects a synchronous drop in the time-series second data that corresponds to a micro motor stall event, a flag or indicator can be raised to indicate the detection of a micro motor stall event. In the event that the collar speed recovers to its original level within a predefined time window (such as 4 to 12 seconds) following the micro motor stall event but the time-series second data is not returning to its original level within such predefined time window, the processing can detect a full motor stall event. In the case that the processing detects a full motor stall event, a flag or indicator can be raised to indicate the detection of the full motor stall event.

In an alternate embodiment, the analysis of 211 can process the time-series first data and the time-series second data to detect a motor stall event if and when the time-series first data corresponds to (or indicates) a drop in rotational speed of the collar and the time-series second data corresponds to (or indicates) a drop in vibration synchronous to the drop in rotational speed of the collar.

Upon detection of a motor stall event of the mud motor, one or more action(s) can be initiated to mitigate and/or eliminate the motor stall event at 211.

In embodiments, the action(s) of 211 can involve alerting a drilling operator to the motor stall event, for example, by communication or display of a message or indicator of the motor stall event. Once alerted, the drilling operator may mitigate and/or eliminate the motor stall event. For example, the drilling operator may adjust the flow rate of the drilling fluid flowing through the mud motor. In some examples, the drilling operator may adjust motor speed of the mud motor. In other embodiments, the drilling operator can reduce weight-on-bit or alternatively increase the mud flow rate. After reducing weight-on-bit, the drilling operator can monitor the drilling operations and slowly increase the weight-on-bit to identify the optimum non stall drilling parameters.

In other embodiments, the action(s) of 211 can involve issuing and communicating at least one control command that automatically adjusts the flow rate of the drilling fluid flowing through the mud motor or automatically adjusts motor speed of the mud motor. In embodiments, the at least one control command can be issued by a control system or processor as described herein. In other examples, such action(s) can involve communication or interaction with a drilling operator to identify and confirm a suitable act or response that mitigates and/or eliminates the stall event in the mud motor. In embodiments, such communication or interaction can be provided by a control system or processor as described herein.

Figure 3:
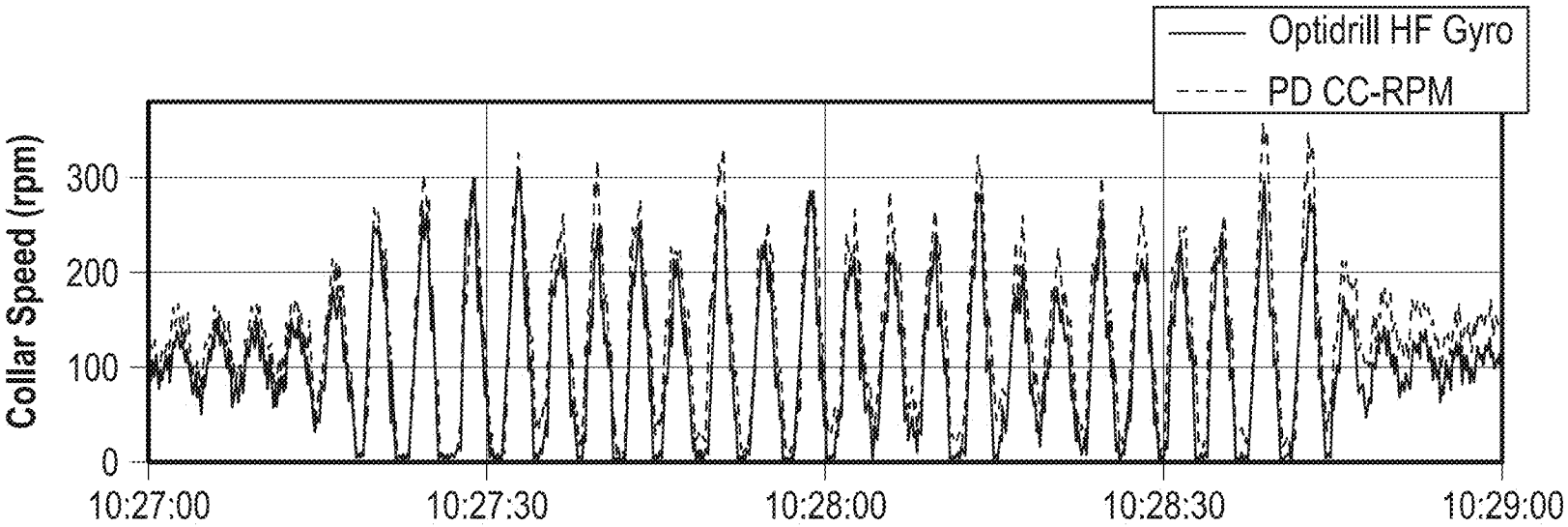
FIG. 3 is a time-series plot of i) rotational speed of a drill bit (CC_RPM channel of an RSS) while drilling an example wellbore and ii) mud motor collar speed (rotational speed of a collar disposed on the uphole end of the downhole motor measured by the gyroscope of a DMM) while drilling the example wellbore.
Figure 4:
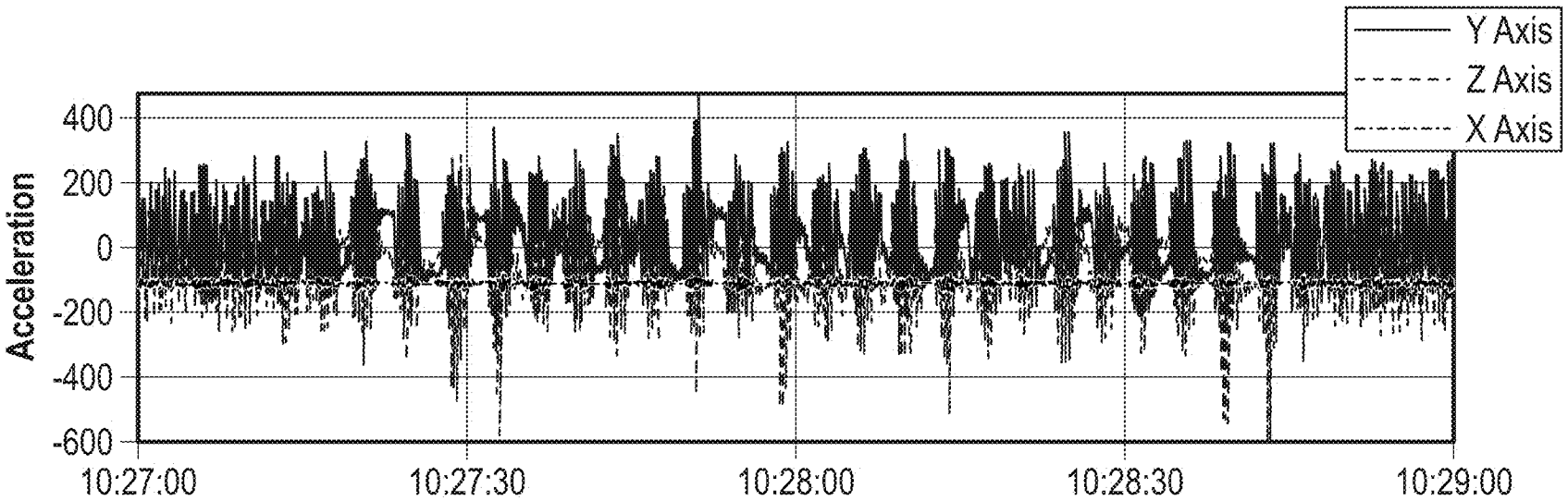
FIG. 4 is a time-series plot of axial accelerometer data while drilling example wellbore over the same time period of FIG. 3.
Figure 5:
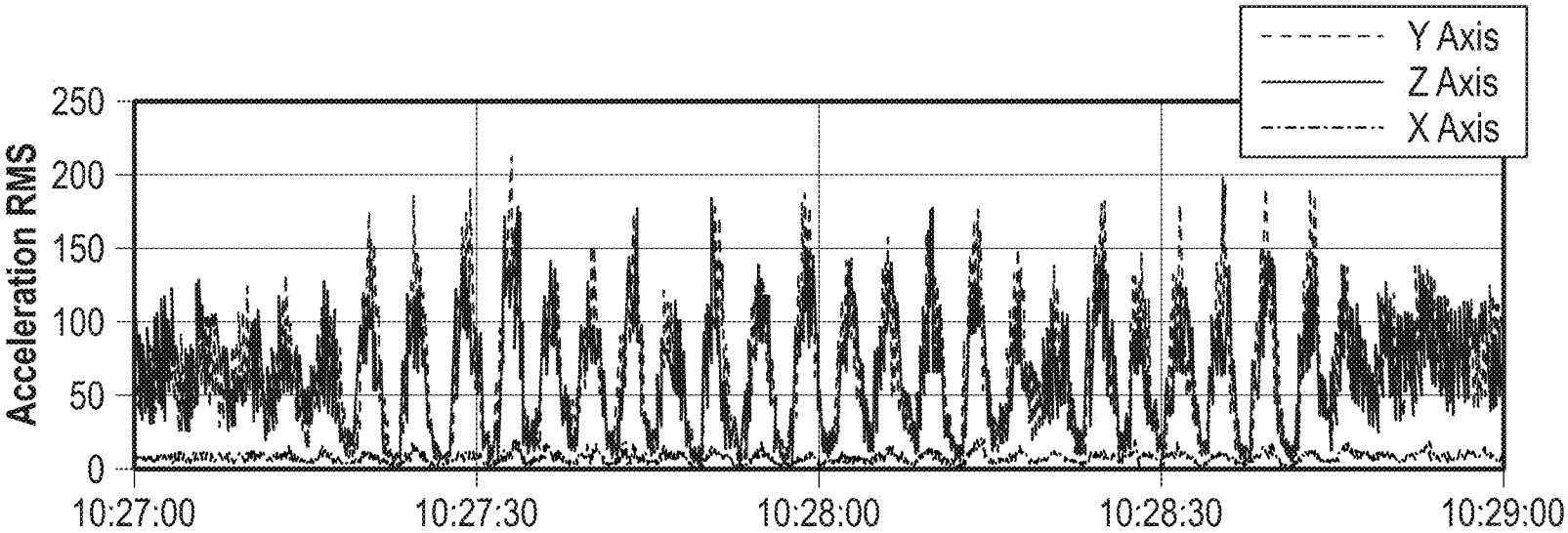
FIG. 5 is a time-series plot of RMS of the axial accelerometer data of FIG. 4 over the same time period of FIGS. 3 and 4.

FIGS. 3 to 5 illustrate data collected while drilling an example well that validates the methods and systems of detecting motor stall events (including micro motor stall events) as described herein. In this example, the well was drilled with a BHA that includes a DMM tool (e.g., Optidrill tool) mounted above a MWD tool and above a mud motor with an RSS and drill bit mounted below the mud motor. The RSS was configured to measure and record rotational speed of the drill bit speed through the CC_RPM channel. The DMM tool includes a gyroscope and triaxial accelerometers. The gyroscope of the DMM tool was configured to measure and record rotational speed of a collar disposed on the uphole end of the mud motor. The triaxial accelerometers of the DMM tool were configured to measure and record vibration of the BHA. Alternatively, these measurements could have been collected from the MWD tool operably disposed above the mud motor.

FIG. 3 is a time-series plot of the rotational speed of the drill bit (CC_RPM channel of the RSS) while drilling and mud motor collar speed (rotational speed of the motor collar measured by the gyroscope of the DMM) while drilling.

FIGS. 4 and 5 are time series plots of axial accelerometer data and RMS of the same data over the same time period of FIG. 3. It is evident from these plots that there are cycles of transient mud motor stall when the drill bit is stationary and other cycles where the drill bit is moving. The plots also show a correlation of the transient mud motor stall cycles with the acceleration (vibration) data of FIGS. 4 and 5.

Figure 6:
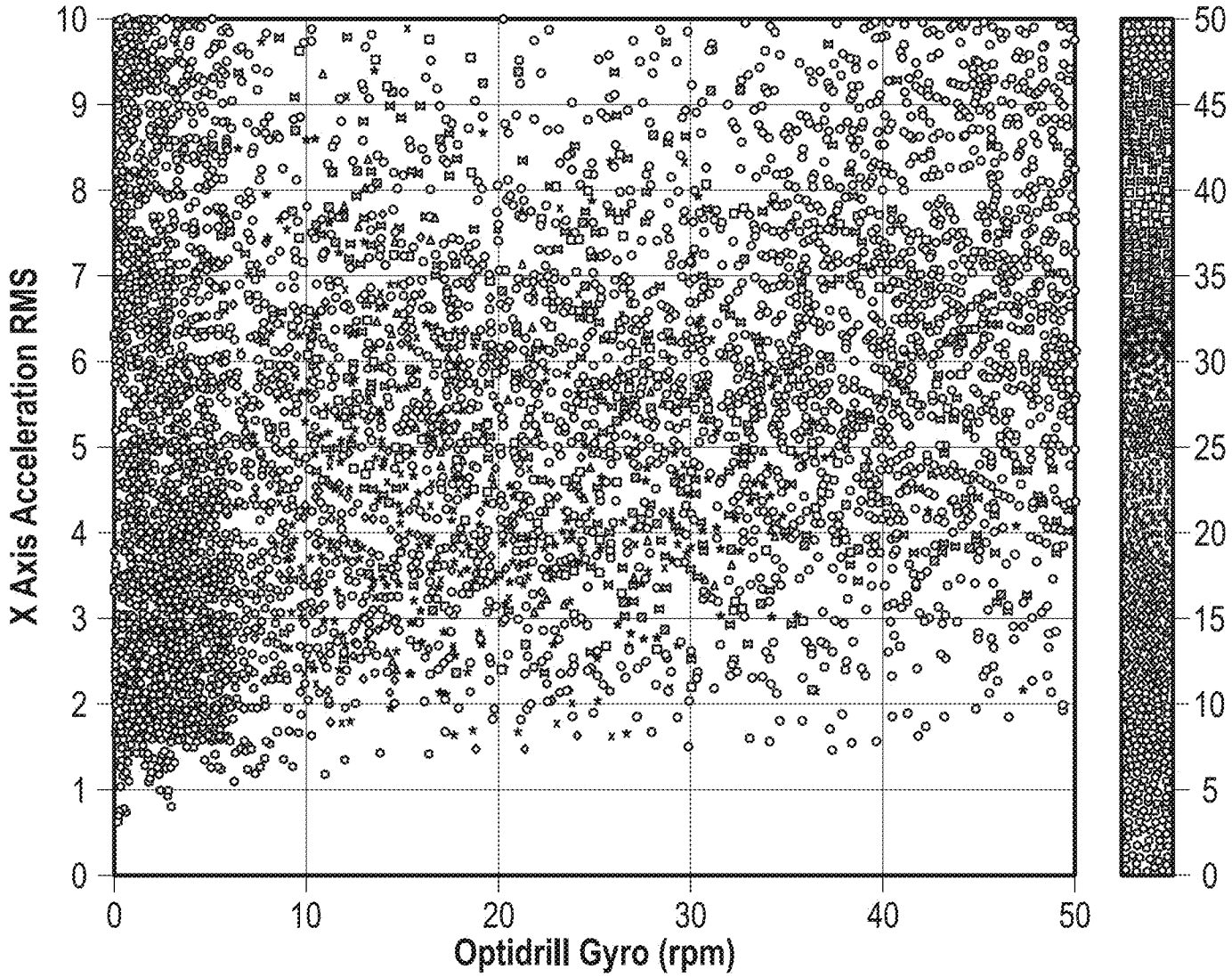
FIGS. 6, 7 and 8 are cross plots of the RMS of the vibration of the BHS (measured by the axial accelerometers of the DMM tool) with mud motor collar speed (rotational speed of a collar disposed on the uphole end of the downhole motor measured by the gyroscope of a DMM) while drilling the example wellbore, which are depicted as points with a gray scale value corresponding to the rotational speed of the drill bit (measured concurrently by the CC_RPM channel of the RSS) while drilling the example wellbore.
Figure 7:
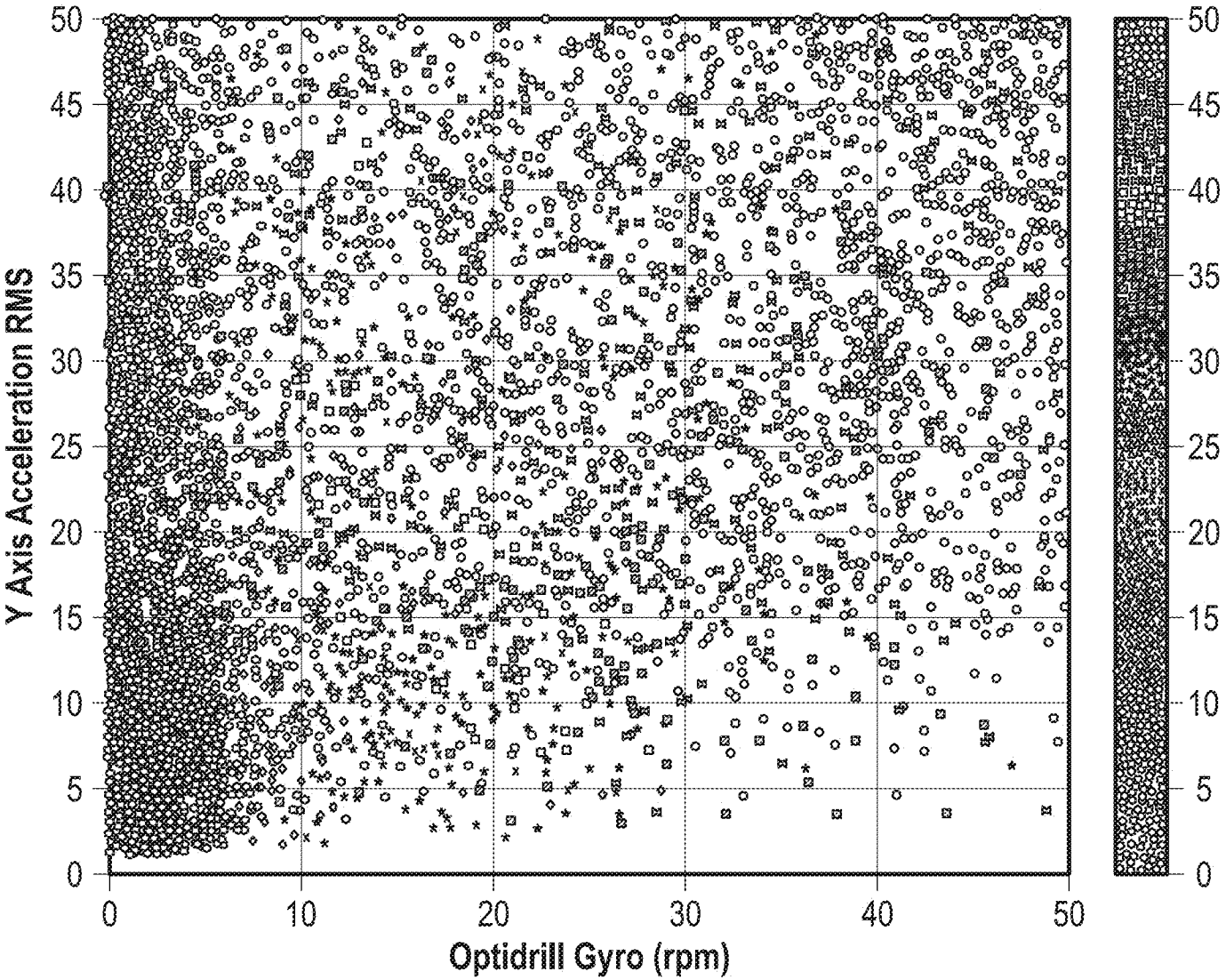
Figure 8:
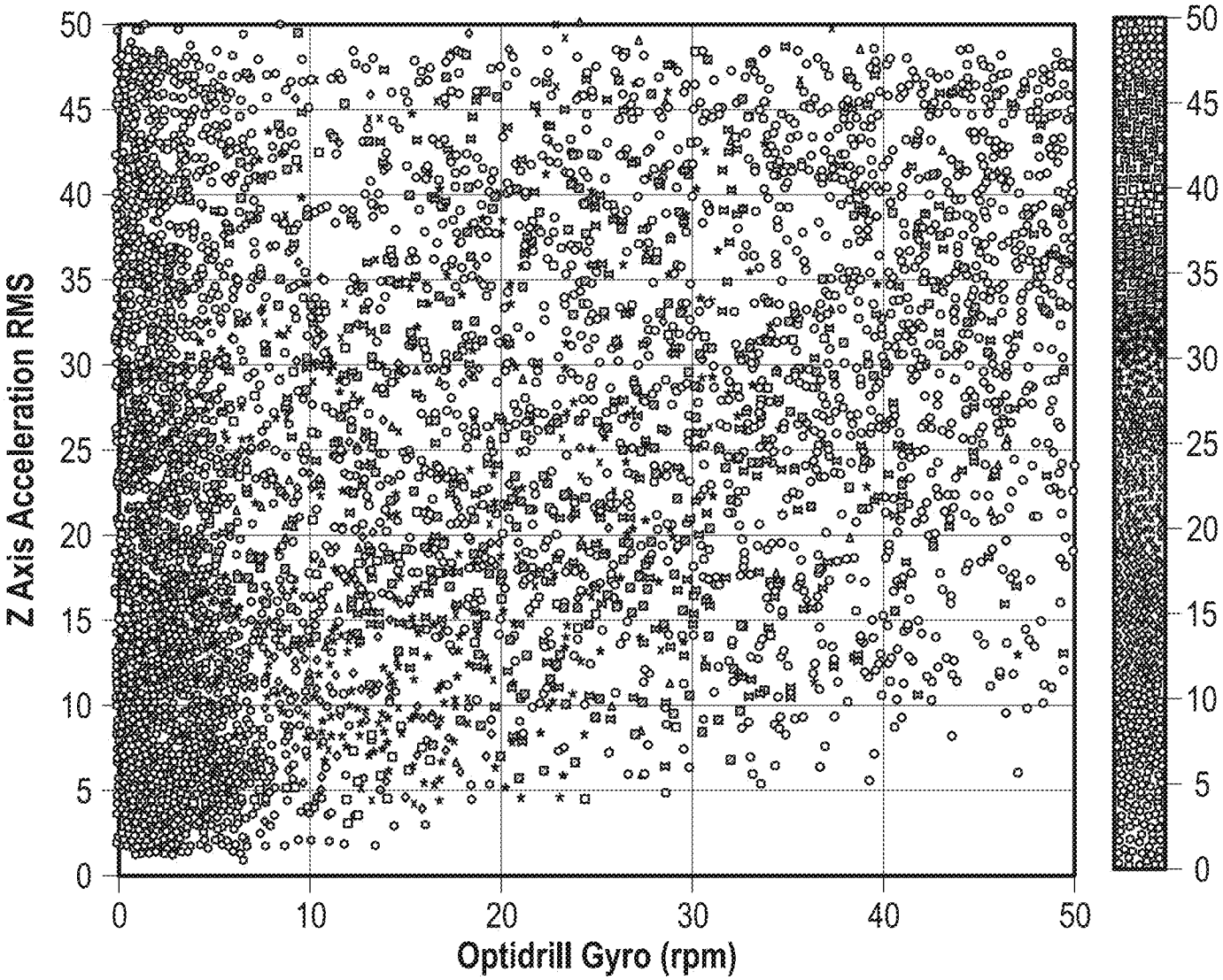

To resolve more detail, FIGS. 6, 7 and 8 are cross plots of the RMS of the vibration of the BHS (measured by the axial accelerometers of the DMM tool) with mud motor collar speed (rotational speed of the motor collar measured concurrently by the gyroscope of the DMM) while drilling the example well, which are depicted as points with a gray scale value corresponding to the rotational speed of the drill bit (measured concurrently by the CC_RPM channel of the RSS) while drilling the example well. It is clear from these cross plots that the motor stall events (when the rotor of the mud motor is stationary) can be detected from the vibration of the BHS (measured by the axial accelerometers of the DMM tool) and the rotational speed of the mud motor collar (measured by the gyroscope of the DMM tool) over the same time periods, which effectively detects and identifies micro motor stall from downhole sensors that are operably disposed above the mud motor.

Figure 9:
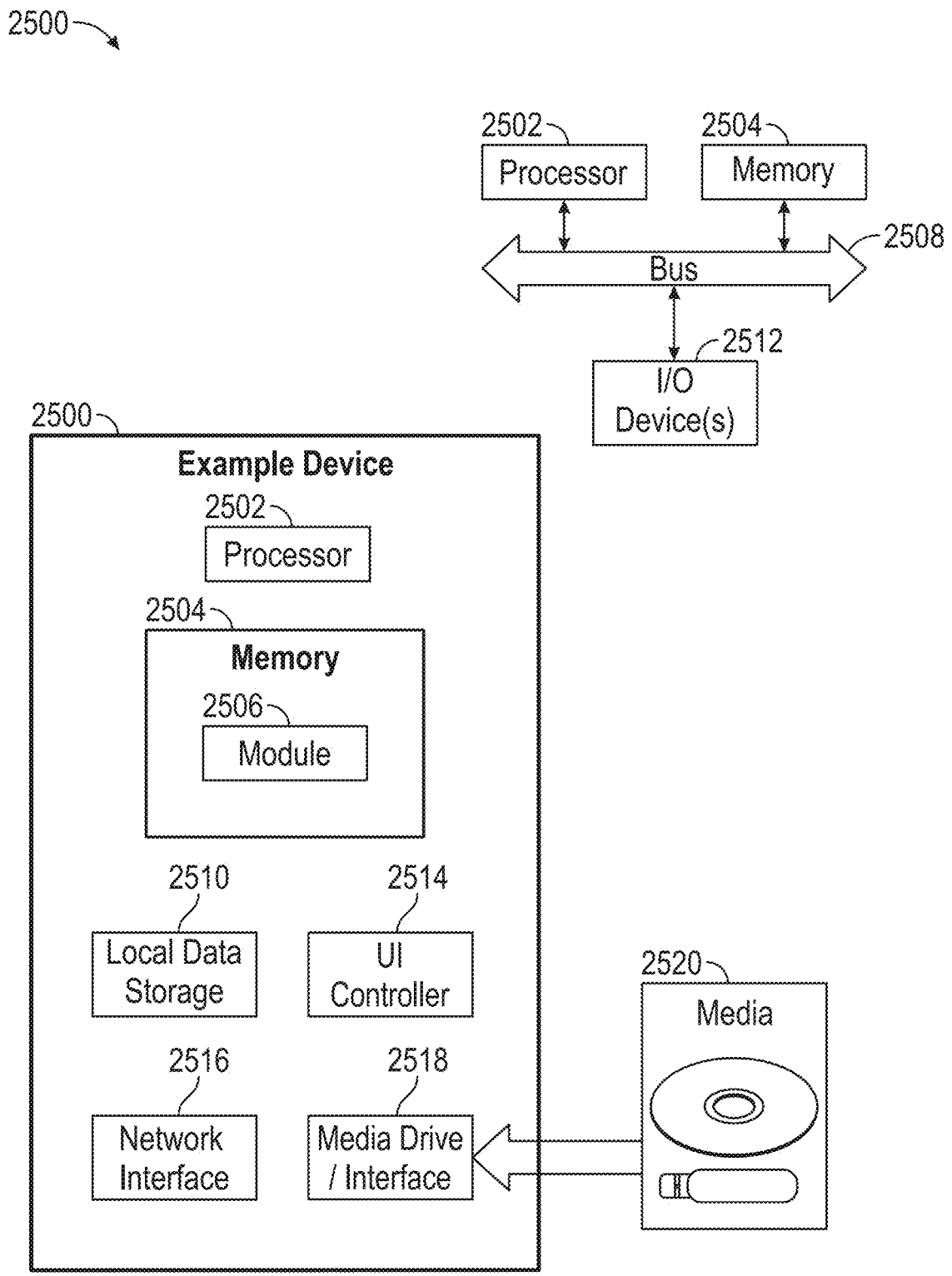
FIG. 9 is a schematic diagram of a computer system that can embody one or more aspects of the present disclosure.

FIG. 9 illustrates an example device 2500, with a processor 2502 and memory 2504 that can be configured to implement various embodiments of the methods and processes as discussed in the present application, including time-synchronization of data representing the measurements of the rotational speed of a mud motor collar (or collar of another part of the BHA disposed above the mud motor) over time and data representing the measurements of vibration of the BHA over time as well as data analysis that automatically detects stall of the mud motor and initiates actions to mitigate and/or eliminate the stall condition of the mud motor.

Memory 2504 can also host one or more databases and can include one or more forms of volatile data storage media such as random-access memory (RAM), and/or one or more forms of nonvolatile storage media (such as read-only memory (ROM), flash memory, and so forth).

Device 2500 is one example of a computing device or programmable device and is not intended to suggest any limitation as to scope of use or functionality of device 2500 and/or its possible architectures. For example, device 2500 can comprise one or more computing devices, programmable logic controllers (PLCs), etc.

Further, device 2500 should not be interpreted as having any dependency relating to one or a combination of components illustrated in device 2500. For example, device 2500 may include one or more computers, such as a laptop computer, a desktop computer, a mainframe computer, etc., or any combination or accumulation thereof.

Device 2500 can also include a bus 2508 configured to allow various components and devices, such as processors 2502, memory 2504, and local data storage 2510, among other components, to communicate with each other.

Bus 2508 can include one or more of any of several types of bus structures, including a memory bus or memory controller, a peripheral bus, an accelerated graphics port, and a processor or local bus using any of a variety of bus architectures. Bus 2508 can also include wired and/or wireless buses.

Local data storage 2510 can include fixed media (e.g., RAM, ROM, a fixed hard drive, etc.) as well as removable media (e.g., a flash memory drive, a removable hard drive, optical disks, magnetic disks, and so forth). One or more input/output (I/O) device(s) 2512 may also communicate via a user interface (UI) controller 2514, which may connect with I/O device(s) 2512 either directly or through bus 2508.

In one possible implementation, a network interface 2516 may communicate outside of device 2500 via a connected network. A media drive/interface 2518 can accept removable tangible media 2520, such as flash drives, optical disks, removable hard drives, software products, etc. In one possible implementation, logic, computing instructions, and/or software programs comprising elements of module 2506 may reside on removable media 2520 readable by media drive/interface 2518.

In one possible embodiment, input/output device(s) 2512 can allow a user (such as a human annotator) to enter commands and information into device 2500, and also allow information to be presented to the user and/or other components or devices. Examples of input device(s) 2512 include, for example, sensors, a keyboard, a cursor control device (e.g., a mouse), a microphone, a scanner, and any other input devices known in the art. Examples of output devices include a display device (e.g., a monitor or projector), speakers, a printer, a network card, and so on.

Various systems and processes of present disclosure may be described herein in the general context of software or program modules, or the techniques and modules may be implemented in pure computing hardware. Software generally includes routines, programs, objects, components, data structures, and so forth that perform particular tasks or implement particular abstract data types. An implementation of these modules and techniques may be stored on or transmitted across some form of tangible computer-readable media. Computer-readable media can be any available data storage medium or media that is tangible and can be accessed by a computing device. Computer readable media may thus comprise computer storage media. "Computer storage media" designates tangible media, and includes volatile and non-volatile, removable, and non-removable tangible media implemented for storage of information such as computer readable instructions, data structures, program modules, or other data. Computer storage media include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other tangible medium which can be used to store the desired information, and which can be accessed by a computer.

Some of the methods and processes described above can be performed by a processor. The term "processor" should not be construed to limit the embodiments disclosed herein to any particular device type or system. The processor may include a computer system. The computer system may also include a computer processor (e.g., a microprocessor, microcontroller, digital signal processor, general-purpose computer, special-purpose machine, virtual machine, software container, or appliance) for executing any of the methods and processes described above.

The computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device.

Alternatively or additionally, the processor may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

Some of the methods and processes described above can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server or electronic bulletin board over a communication system (e.g., the Internet or World Wide Web).

Although only a few example embodiments have been described in detail above, those skilled in the art will readily appreciate that many modifications are possible in the example embodiments without materially departing from this invention.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A method for detecting and mitigating stall of a downhole motor driven by flow of drilling fluid through the downhole motor, the method comprising:

providing a bottomhole assembly (BHA) that includes at least one first downhole sensor and at least one second downhole sensor which are both operably disposed above the downhole motor;

configuring the at least one first downhole sensor to measure rotational speed of a collar, wherein the collar is disposed at an uphole end of the downhole motor or is part of the BHA disposed above the downhole motor;

configuring the at least one second downhole sensor to measure vibration of the BHA;

generating time-series first data representing measurements of the rotational speed of the collar made by the at least one first downhole sensor over time;

generating time-series second data representing measurements of the vibration of the BHA made by the at least one second downhole sensor over time;

automatically detecting stall of the downhole motor by analysis of the time-series first data and the time-series second data, wherein the analysis of the time-series first data and the time-series second data comprises i) evaluating rotational speed of the collar using one or more conditions corresponding to stall of the downhole motor, and ii) evaluating vibration of the BHA using one or more conditions that detect a synchronous drop in the time-series second data that corresponds to stall of the downhole motor; and upon detecting stall of the downhole motor, initiating at least one action to mitigate the stall of the downhole motor.

2. The method of claim 1, wherein:

the analysis of the time-series first data and the time-series second data is configured to automatically detect stall of the downhole motor if and when the time-series first data corresponds to, or indicates, a stationary collar at or near null rotational speed and the time-series second data corresponds to, or indicates, a drop in vibration synchronous to the stationary collar at or near null rotational speed.

3. The method of claim 1, wherein:

the analysis of the time-series first data and the time-series second data is configured to automatically detect stall of the downhole motor if and when the time-series first data corresponds to, or indicates, a drop in rotational speed of the collar and the time-series second data corresponds to, or indicates, a drop in vibration synchronous to the drop in rotational speed of the collar.

4. The method of claim 1, wherein the analysis of the time-series first data and the time-series second data involves:

computing a characteristic rotational speed of the collar which is evaluated in i) using one or more conditions corresponding to stall of the downhole motor; and computing a characteristic vibration level of the BHA, which is evaluated in ii) using the one or more conditions that detect a synchronous drop in the time-series second data that corresponds to stall of the downhole motor.

5. The method of claim 1, wherein:

the at least one action involves alerting a drilling operator to the stall of the downhole motor.

6. The method of claim 5, wherein:

the alerting comprises communication or display of a message or indicator of the stall of the downhole motor.

7. The method of claim 5, wherein:

the at least one action further involves the drilling operator adjusting flow rate of the drilling fluid flowing through the downhole motor or adjusting motor speed of the downhole motor.

8. The method of claim 1, wherein:

the at least one action involves issuing and communicating at least one control command that automatically adjusts flow rate of the drilling fluid flowing through the downhole motor or automatically adjusts motor speed of the downhole motor.

9. The method of claim 8, wherein:

the at least one control command is issued by a control system or processor.

10. The method of claim 1, wherein:

the stall of the downhole motor comprises a micro motor stall event or a full motor stall event.

11. A directional drilling system comprising:

a bottomhole assembly (BHA) that includes a drill bit, a downhole motor, and at least one first downhole sensor and at least one second downhole sensor which are both operably disposed above the downhole motor, wherein the downhole motor is driven by flow of drilling fluid through the downhole motor, wherein the at least one first downhole sensor is configured to measure rotational speed of a collar, wherein the collar is disposed at an uphole end of the downhole motor or is part of the BHA disposed above the downhole motor, and wherein the at least one second downhole sensor is configured to measure vibration of the BHA; and at least one processor configured to:

i) generate time-series first data representing measurements of the rotational speed of the collar made by the at least one first downhole sensor over time;

ii) ii) generate time-series second data representing measurements of the vibration of the BHA made by the at least one second downhole sensor over time;

iii) iii) automatically detect stall of the downhole motor by analysis of the time-series first data and the time-series second data, wherein the analysis of the time-series first data and the time-series second data comprises i) evaluating rotational speed of the collar using one or more conditions corresponding to stall of the downhole motor, and ii) evaluating vibration of the BHA using one or more conditions that detect a synchronous drop in the time-series second data that corresponds to stall of the downhole motor; and iv) iv) upon detecting stall of the downhole motor, initiate at least one action to mitigate the stall of the downhole motor.

12. The directional drilling system of claim 11, wherein:

the analysis of the time-series first data and the time-series second data is configured to automatically detect stall of the downhole motor if and when the time-series first data corresponds to, or indicates, a stationary collar at or near null rotational speed and the time-series second data corresponds to, or indicates, a drop in vibration synchronous to the stationary collar at or near null rotational speed.

13. The directional drilling system of claim 11, wherein:

the analysis of the time-series first data and the time-series second data is configured to automatically detect stall of the downhole motor if and when the time-series first data corresponds to, or indicates, a drop in rotational speed of the collar and the time-series second data corresponds to, or indicates, a drop in vibration synchronous to the drop in rotational speed of the collar.

14. The directional drilling system of claim 11, wherein the analysis of the time-series first data and the time-series second data involves:

computing a characteristic rotational speed of the collar using one or more conditions corresponding to stall of the downhole motor; and computing a characteristic vibration level of the BHA, which is evaluated in ii) using the one or more conditions that detect a synchronous drop in the time-series second data that corresponds to stall of the downhole motor.

15. The directional drilling system of claim 11, wherein:

the at least one action involves alerting a drilling operator to the stall of the downhole motor.

16. The directional drilling system of claim 15, wherein:

the alerting comprises communication or display of a message or indicator of the stall of the downhole motor.

17. The directional drilling system of claim 15, wherein:

the at least one action further involves the drilling operator adjusting flow rate of the drilling fluid flowing through the downhole motor or adjusting motor speed of the downhole motor.

18. The directional drilling system of claim 11, wherein:

the at least one action involves issuing and communicating at least one control command that automatically adjusts flow rate of the drilling fluid flowing through the downhole motor or automatically adjusts motor speed of the downhole motor.

19. The directional drilling system of claim 11, wherein: the stall of the downhole motor comprises a micro motor stall event or a full motor stall event.

* * * * *